US011786050B2

(12) United States Patent
Deragon

(10) Patent No.: US 11,786,050 B2
(45) Date of Patent: Oct. 17, 2023

(54) MATTRESS WITH VARIABLE HEIGHT AND HARDNESS AND METHOD FOR ADJUSTING THE HEIGHT AND HARDNESS OF THE SAME

(71) Applicant: Benoit Deragon, Granby (CA)

(72) Inventor: Benoit Deragon, Granby (CA)

( * ) Notice: Subject to any disclaimer, the term of this patent is extended or adjusted under 35 U.S.C. 154(b) by 10 days.

(21) Appl. No.: 16/796,834

(22) Filed: Feb. 20, 2020

(65) Prior Publication Data

US 2020/0260881 A1 Aug. 20, 2020

Related U.S. Application Data

(60) Provisional application No. 62/808,123, filed on Feb. 20, 2019.

(51) Int. Cl.

| | |
|---|---|
| ***A47C 27/00*** | (2006.01) |
| ***A47C 27/14*** | (2006.01) |
| ***A47C 31/02*** | (2006.01) |
| ***A47C 27/15*** | (2006.01) |
| ***A47C 21/02*** | (2006.01) |
| ***A47C 31/10*** | (2006.01) |

(52) U.S. Cl.

CPC ..... *A47C 27/001* (2013.01); *A47C 21/022* (2013.01); *A47C 27/148* (2013.01); *A47C 27/15* (2013.01); *A47C 31/023* (2013.01); *A47C 31/105* (2013.01)

(58) Field of Classification Search

CPC ..... A47C 27/14; A47C 27/142; A47C 27/144; A47C 27/146; A47C 27/148; A47C 27/001; A47C 27/061; A47C 27/15; A47C 21/022; A47C 31/023; A47C 31/105

See application file for complete search history.

(56) References Cited

U.S. PATENT DOCUMENTS

| | | | | | |
|---|---|---|---|---|---|
| 2,154,910 | A | * | 4/1939 | Magaril | A47C 27/05 5/722 |
| 2,651,788 | A | * | 9/1953 | Forwood | A47C 27/15 5/1 |
| 3,534,417 | A | * | 10/1970 | Boyles | A47C 27/16 5/727 |
| 4,213,214 | A | * | 7/1980 | Gilhooly | A47C 27/001 5/679 |
| 4,449,261 | A | * | 5/1984 | Magnusson | A47C 27/066 5/722 |
| 4,955,095 | A | * | 9/1990 | Gerrick | A47C 31/105 5/691 |
| 5,136,741 | A | * | 8/1992 | Balonick | A47C 27/001 5/699 |
| 5,398,354 | A | * | 3/1995 | Balonick | A47C 27/148 5/728 |
| 5,428,852 | A | * | 7/1995 | Tenuta | A47C 31/105 5/738 |

(Continued)

*Primary Examiner* — David R Hare

(74) *Attorney, Agent, or Firm* — Brouillette Legal Inc.; Robert Brouillette

(57) ABSTRACT

A mattress having variable height and hardness is disclosed. The mattress comprises a base layer held by a mattress cover using an extendable attachment system. The mattress further comprises one or more top layers made of resilient material which are stacked on top of the base layer. Only friction between the material of the top layers limit the lateral or longitudinal movements of a layer with regard to another layer.

19 Claims, 10 Drawing Sheets

(56) References Cited

U.S. PATENT DOCUMENTS 5,528,784 A * 6/1996 Painter ..... A47G 9/10 5/636
5,642,543 A * 7/1997 Huntley ..... A47G 9/10 5/490
5,819,349 A * 10/1998 Schwartz ..... A47C 27/001 5/722
5,960,496 A * 10/1999 Boyd ..... A47C 27/18 5/931
6,115,861 A * 9/2000 Reeder ..... A61G 7/05776 5/690
6,163,907 A * 12/2000 Larson ..... A47C 21/048 5/691
6,687,935 B2 * 2/2004 Reeder ..... A61G 7/05776 5/691
7,661,166 B1 * 2/2010 Marling ..... A47C 27/146 5/691
9,962,008 B1 * 5/2018 Omiste ..... A47C 21/048
10,582,779 B2 * 3/2020 Roma ..... A47C 27/148
10,624,464 B2 * 4/2020 Shuaib ..... A47C 21/026
2004/0003471 A1 * 1/2004 VanSteenburg ..... A47C 27/081 5/709
2008/0301983 A1 * 12/2008 Murphy ..... G09F 23/00 5/690
2010/0138992 A1 * 6/2010 Morrison ..... A47C 31/00 5/279.1
2010/0154125 A1 * 6/2010 Fratovich ..... A47C 31/02 5/691
2013/0192001 A1 * 8/2013 Rensink ..... A47C 31/00 5/691
2014/0182060 A1 * 7/2014 Mikkelsen ..... A47C 19/025 5/400
2014/0201925 A1 * 7/2014 Tursi, Jr. ..... A47C 27/14 5/722
2015/0096121 A1 * 4/2015 Scarleski ..... A47C 31/105 5/484
2017/0035211 A1 * 2/2017 Alletto, Jr. ..... A47C 23/002
2017/0119168 A1 * 5/2017 Al-Hazeem ..... A47C 27/062
2017/0156508 A1 * 6/2017 Segal ..... A47C 27/001
2017/0224126 A1 * 8/2017 O'Connell, Jr. ..... A47G 9/10
2018/0027986 A1 * 2/2018 Schulte ..... A47C 27/085
2019/0133334 A1 * 5/2019 Kho ..... A47C 27/045
2019/0313809 A1 * 10/2019 Dolter ..... A47C 31/105

* cited by examiner

MATTRESS WITH VARIABLE HEIGHT AND HARDNESS AND METHOD FOR ADJUSTING THE HEIGHT AND HARDNESS OF THE SAME

CROSS-REFERENCE TO RELATED APPLICATIONS

The present patent application claims the benefits of priority of U.S. Provisional Patent Application No. 62/808,123, entitled "MATTRESS WITH VARIABLE HEIGHT AND HARDNESS", and filed at the United States Patent and Trademark Office on Feb. 20, 2019, the content of which is incorporated herein by reference.

FIELD OF THE INVENTION

The present invention generally relates to the field of mattresses. More particularly, the present invention relates to systems and methods for adjusting height hardness of a mattress based on the need of a user.

BACKGROUND OF THE INVENTION

Nowadays, a mattress plays a very important role in the daily lives of humans. A comfortable mattress may make the daily life of humans more enjoyable. However, as people age or get injured, a mattress may become unfit to the needs of a user, being too firm or too soft.

As an example, young people typically enjoy firm mattresses while softer mattresses may be fit for most elder people. In the meantime, people may develop special physical conditions requiring a different mattress hardness.

Mattresses having replacements parts are known in the art. As an example, U.S. Pat. No. 5,136,741 discloses a mattress having replaceable parts. The mattress comprises a base portion attachable to a cover portion by a zipper. The zipper maintains the height of the mattress and allow replacing parts with similar parts.

There is thus a need for a mattress allowing changes in firmness and changes in height.

SUMMARY OF THE INVENTION

The aforesaid and other objectives of the present invention are realized by generally providing a mattress having variable height and hardness.

In an aspect of the invention, a mattress having variable height and hardness is provided. The mattress comprises a base layer held by a mattress cover using an extendable attachment system. The mattress further comprises one or more top layers made of resilient material which are stacked on top of the base layer. The lateral or longitudinal movements of a layer with regard to another layer is generally restricted by friction between the material of each layers. In some embodiments, layers may have variable profiles, such as intermittently spaced extrusions of material, which may be recessed with other extrusions of adjacent layers as to add a supplemental lateral and longitudinal movement restriction.

In another aspect of the invention, the expandable attachment system comprises a first buckle and a second buckle adapted to mate and attach with the first buckle. A first strap is attached to the mattress cover and a second strap is attached to the base layer cover or to the base layer, typically at the bottom of the base cover or of the base layer. The first buckle is fixedly attached to one of the two straps and the second buckle is fixedly attached to the second strap. The attachment system further comprises a length adjusting mechanism.

In another aspect of the invention is provided a mattress with adjustable height and hardness, the mattress comprising a base layer comprising a top surface, a bottom surface and a plurality of side surfaces, at least an upper layer comprising a top surface, a bottom surface and a plurality of side surfaces, the upper layer being made of resilient material and adapted to stack over the base layer, a flexible cover adapted to cover the top surface of the topmost upper layer and to cover at least partially the side surfaces of the upper layers, a plurality of attachment mechanisms having a length adapted to vary according to the height of the mattress, each attachment mechanism comprising: a first member attached to the flexible cover, a second member secured to the base layer and wherein the first member and the second member are adapted to detachably mate to one another to solidly maintain the flexible cover to the base layer.

In yet another aspect of invention, a method for adjusting height and firmness of a mattress is also provided. The method comprises providing a base mattress layer adapted to support weight of a user and stacking resilient layers on top of the base layer to adjust height and firmness of the mattress. The method further comprises wrapping a mattress cover over a top surface of the topmost resilient layer, over the sides of the resilient layers and over at least a portion of side walls of the base mattress layer. The method also comprises attaching the base layer to the wrapped cover of the mattress and tightening the base layer to the wrapped cover. The tightening of the cover results in the side of the cover to wrap around the side of the base layer.

In a further aspect of the invention, a method for building a height and/or firmness adjustable mattress is provided. The method comprises providing a base layer adapted to receive a predetermined load, stacking one or more resilient upper layers on top of the base layer based on predetermined desired characteristics, wrapping a top surface and at least partially covering side surfaces of the topmost upper layer with a flexible cover, adjusting length of each of a plurality of attachment mechanisms according to the height of the stacked base and upper layers, each of the attachment mechanisms being mounted to the base layer and to the flexible cover, securing, for each attachment system, the first attachment member to the second attachment member, and tightening each of the attachment mechanisms to limit movement of the base and upper layers.

In yet another aspect of the invention, a method for adjusting height and/or firmness of a mattress is a provided. The method comprises detaching one or more attachment systems holding a cover to a base layer of the mattress, removing a cover wrapped over a top surface of the topmost of the upper layers of the mattress, replacing one or more upper layers with one or more replacement upper layers, and adapting the length of the attachment systems to compensate for the difference of height after replacement of the one or more upper layers.

The features of the present invention which are believed to be novel are set forth with particularity in the appended claims.

BRIEF DESCRIPTION OF THE DRAWINGS

The above and other objects, features and advantages of the invention will become more readily apparent from the following description, reference being made to the accompanying drawings in which.

DETAILED DESCRIPTION OF THE PREFERRED EMBODIMENT

A mattress with variable height and hardness and method for adjusting the height and harness of the same will be described hereinafter. Although the invention is described in terms of specific illustrative embodiment(s), it is to be understood that the embodiment(s) described herein are by way of example only and that the scope of the invention is not intended to be limited thereby.

Figure 1:
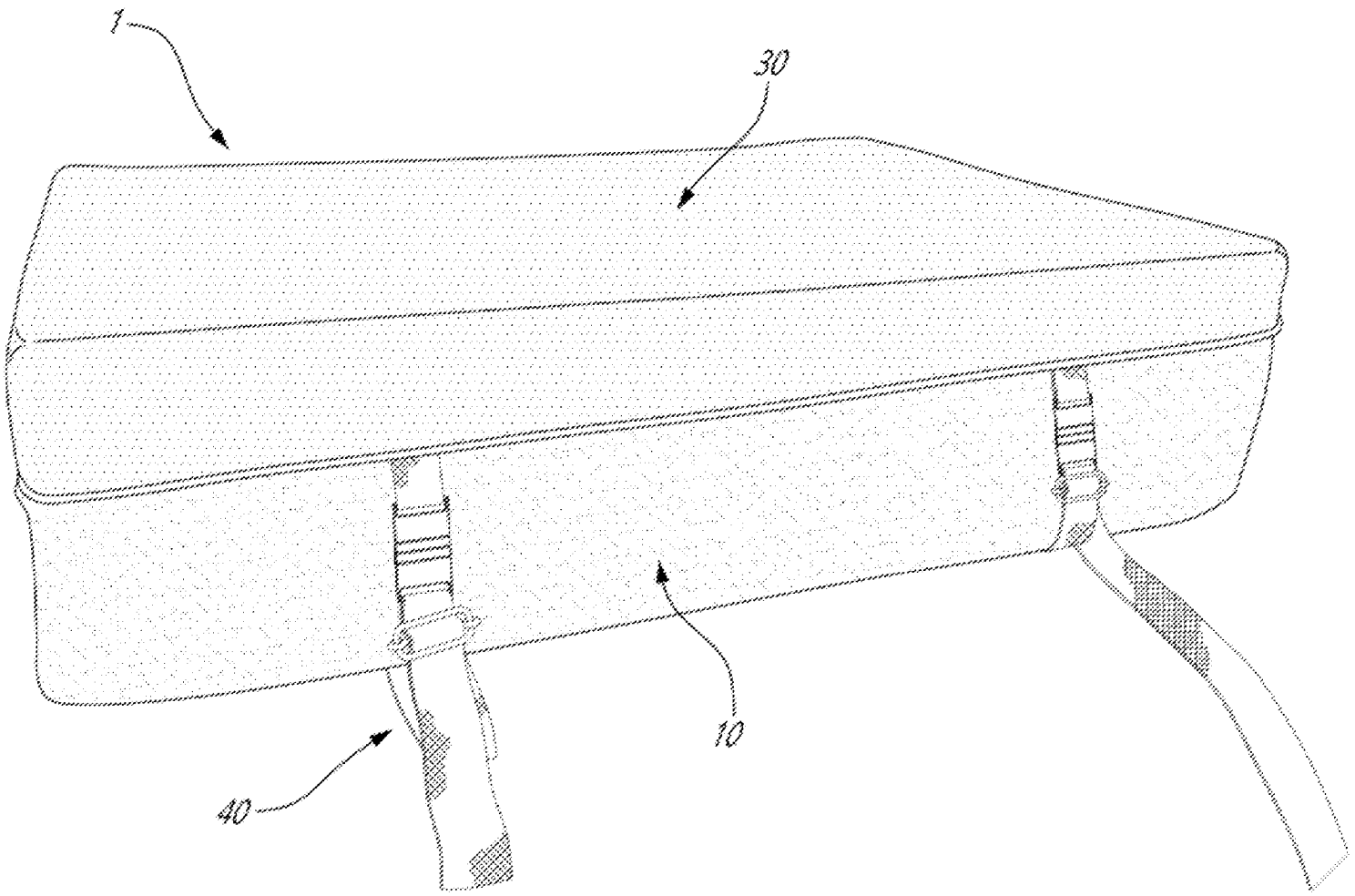
FIG. 1 is a perspective view of an embodiment of a mattress having variable height and hardness in accordance with the principles of the present invention.

Now referring to FIG. 1, an embodiment of a mattress having variable height and hardness 1 is shown in operation. As shown, the mattress 1 at least comprises a base layer 10, held by a mattress cover 30 using an extendable attachment system 40.

Figure 2:
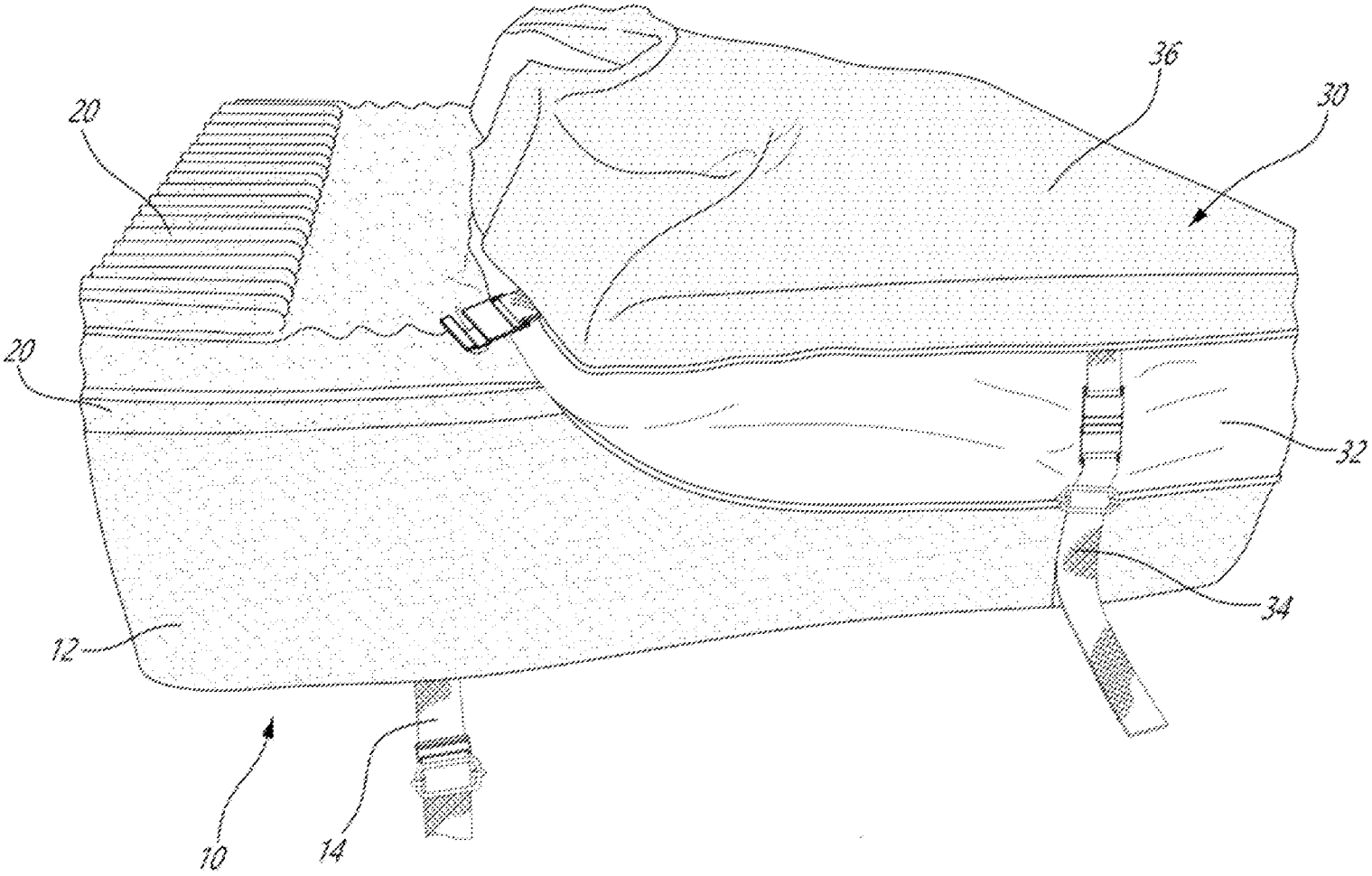
FIG. 2 is a perspective view of the mattress of FIG. 1 shown with a portion of the cover being removed.
Figure 5:
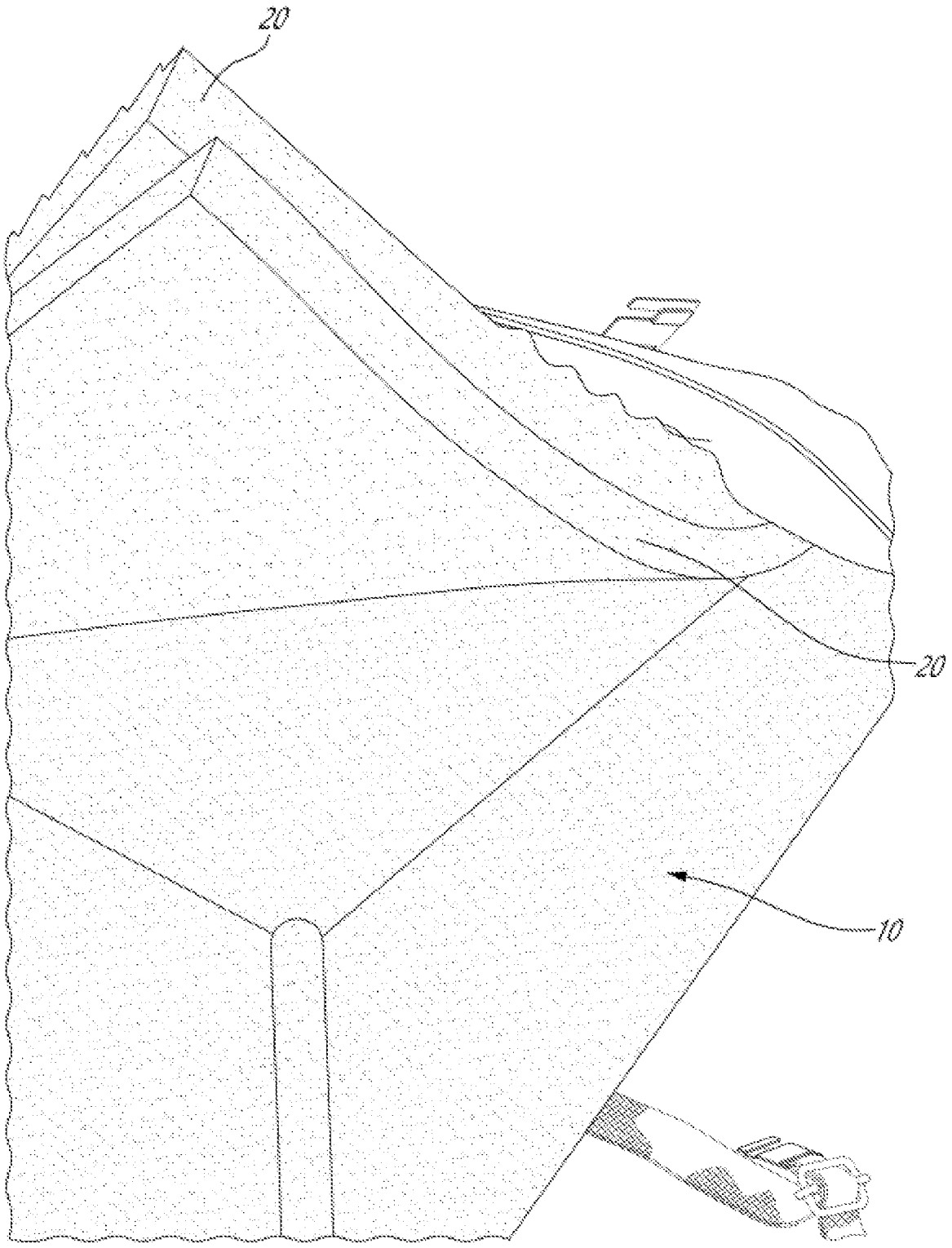
FIG. 5 is a perspective view of an end of the mattress of FIG. 1 shown with a portion of the cover being removed.

Now referring to FIGS. 2 and 5, the mattress 1 of FIG. 1 is shown with a portion of the cover 30 being detached and showing an interior portion of the mattress 1. In such an embodiment, two top layers 20 made of resilient material are stacked on top of the base layer 10. The top layers 20 are typically made of resilient material, such as foam, latex or any other resilient material known in the art. In embodiments having more than one top layer 20, the different layers 20 are stacked on top of the base layer 10 and on top of each another. As to allow modifying the different layers 20, the layers 20 are not attached to one another. Typically, friction between the material of the layers 20 limits the lateral or longitudinal movements of a layer 20 with regard to another layer 20.

Figure 6:
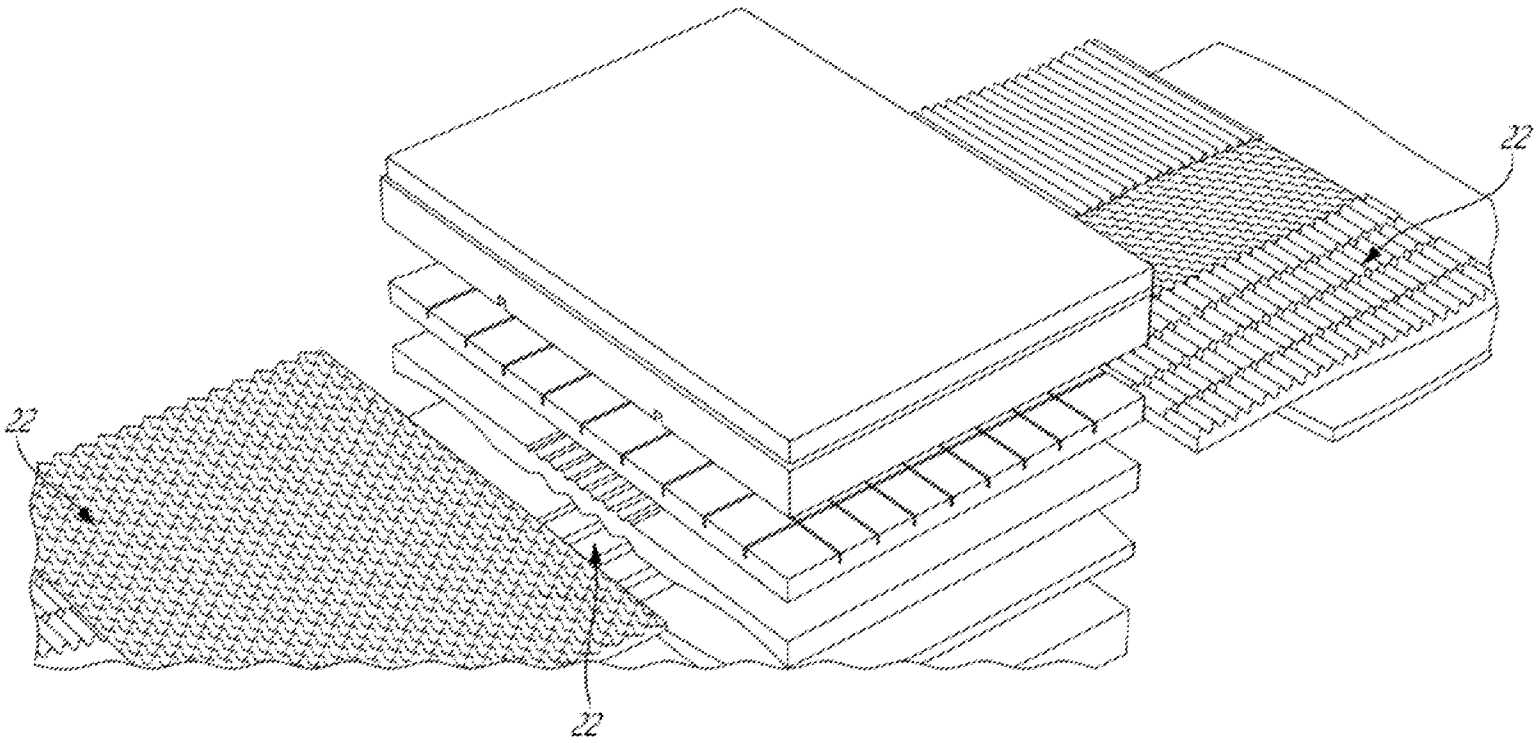
FIG. 6 is a perspective view of an embodiment of a mattress comprising multiple flexible layers with some of them comprising extrusions.

Now referring to FIG. 6, in some embodiments, the upper layers 20 may comprise extrusions 22. In some further embodiments, the top and/or bottom surfaces of the upper layers 20 may comprise recesses adapted to mate with or to be received by protrusions or extrusions 22 of bottom and/or top surface of an adjacent upper layer 20. Such matching recesses and protrusions generally aims at increasing friction between the upper layers 20, thus limiting lateral and longitudinal movements between upper layers 20.

The top layers 20 are typically made of different materials providing different firmness levels. Generally, to provide comfort, the top layers 20 have a firmness or hardness level lower than the firmness of the base layer 10.

Figure 3:
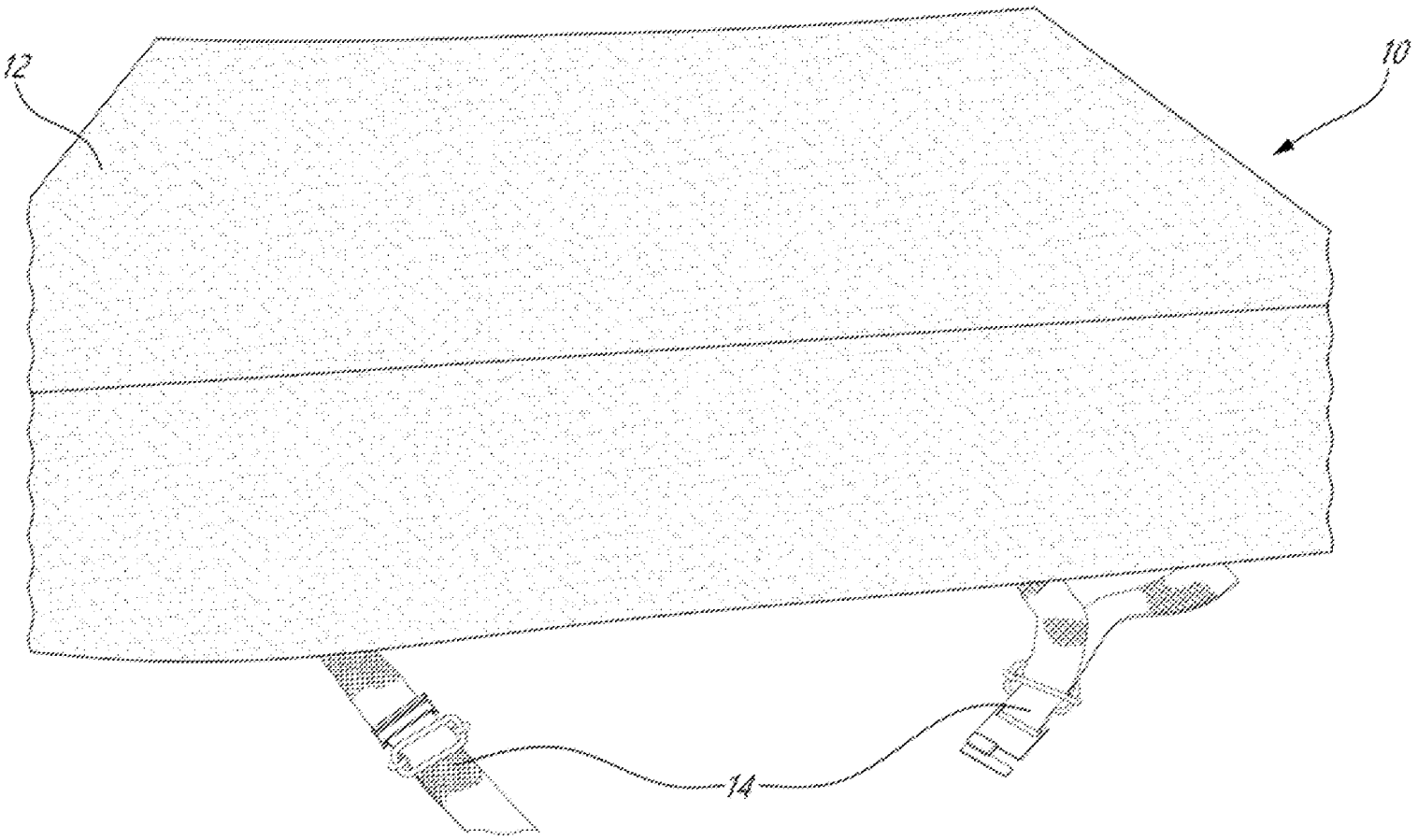
FIG. 3 is a perspective view of an embodiment of a base layer of a mattress having variable height and hardness.
Figure 4:
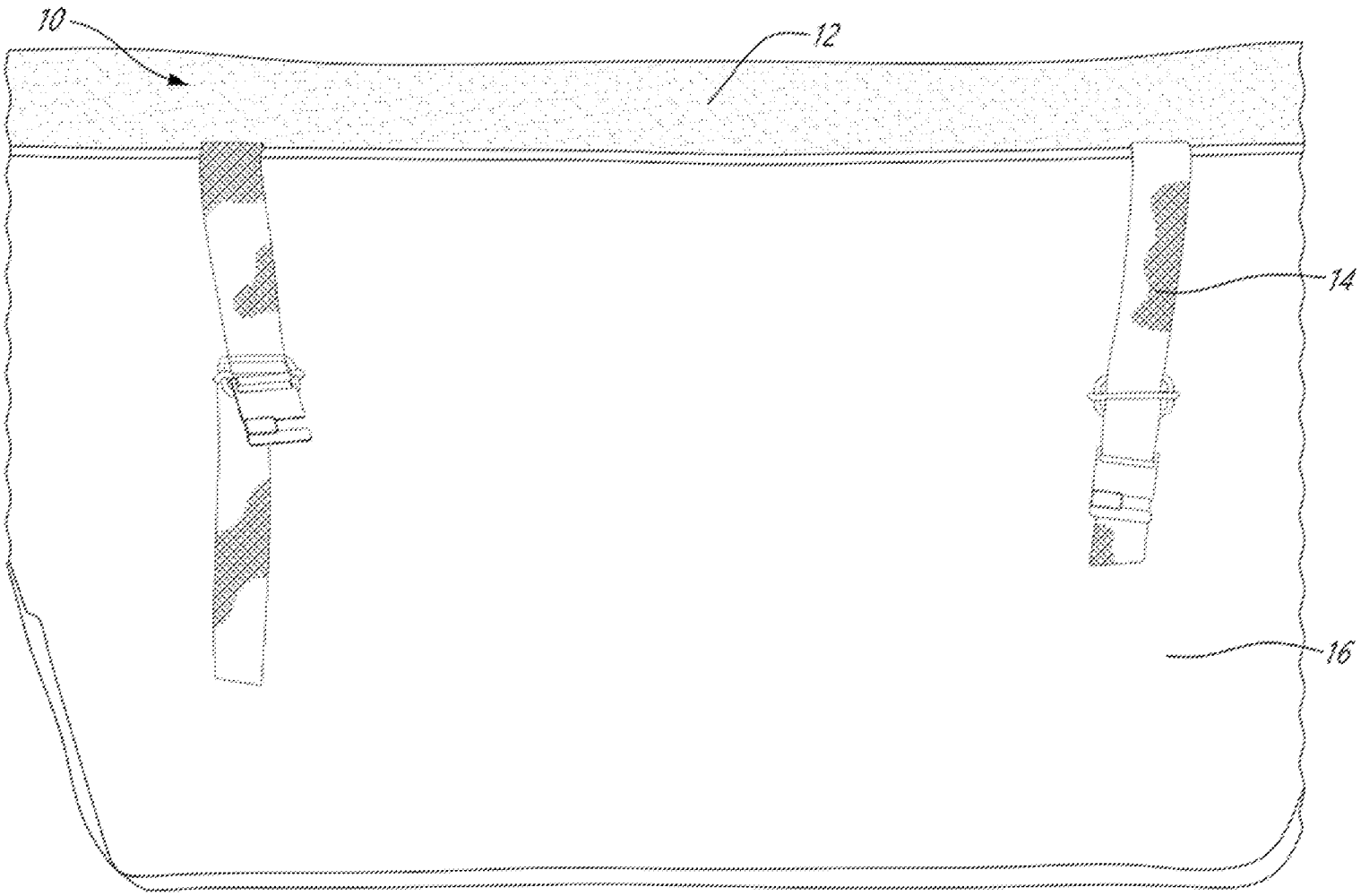
FIG. 4 is a perspective view of an underneath portion of the base layer of FIG. 3.

Now referring to FIGS. 3 and 4, an embodiment of a base layer 10 is shown without top layers 20 and cover 30. Any known mattress base layer 10 may be used, such as a base layer 10 comprising springs, a foam-based base layer 10, a latex-based layer 10 or any other resilient yet firm material. The base layer 10 typically comprises a slipcover or cover 12 adapted to wrap around the base layer 10. In some embodiments, the cover 12 is made of elastic or expandable material allowing a tight fit of the cover 12 with the base layer 10. In other embodiments, the cover 12 may be made of a rigid or semi-rigid material which may also allow a tight fit of the cover 12 with the base layer 10. The bottom section of the base cover 12 may further comprise an a retainer means, such as an elastic band. The retainer means generally aims at improving the fit of the cover 12 over the base layer 10 an may have both functional and aesthetical advantages.

In yet other embodiments, the cover 12 may be a pocket or bag having an opening adapted to generally receive the width and length of the base layer 10. The cover 12 generally aims at providing a barrier against dust, particles or other contaminants. As the cover 12 is typically removable, the said cover 12 may be cleaned if needed and, when removed, allows drying of the base layer 10 if needed. In exemplary embodiments, the opening of the cover 12 may be closed using any closing system, such as a zipper or as buttons.

The cover 12 of the base further comprises one or more attachment members 14. Typically, the attachment member 14 is sewn or firmly attached to the cover 12. The cover 12 may further comprises top and/or bottom surfaces 16 made of a different material than the remaining of the cover 12. Such different material may have impermeable, frictionless or increased friction characteristics.

In other embodiments, the cover 12 may be omitted and the attachment member 14 is attached directly to the base layer 10.

Understandably, any known mattress base may be used as the base layer 10. As an example, a base layer 10 may comprise a body filled with various stuffing materials, such as latex foam, urethane foam, natural fibers, etc. The base layer may also comprise several cushion springs and, optionally, wood members disposed in the body. The base layer 10 is generally sized to fit standard bed dimensions, such as a single bed, a queen bed, a king bed and so on.

Figure 7:
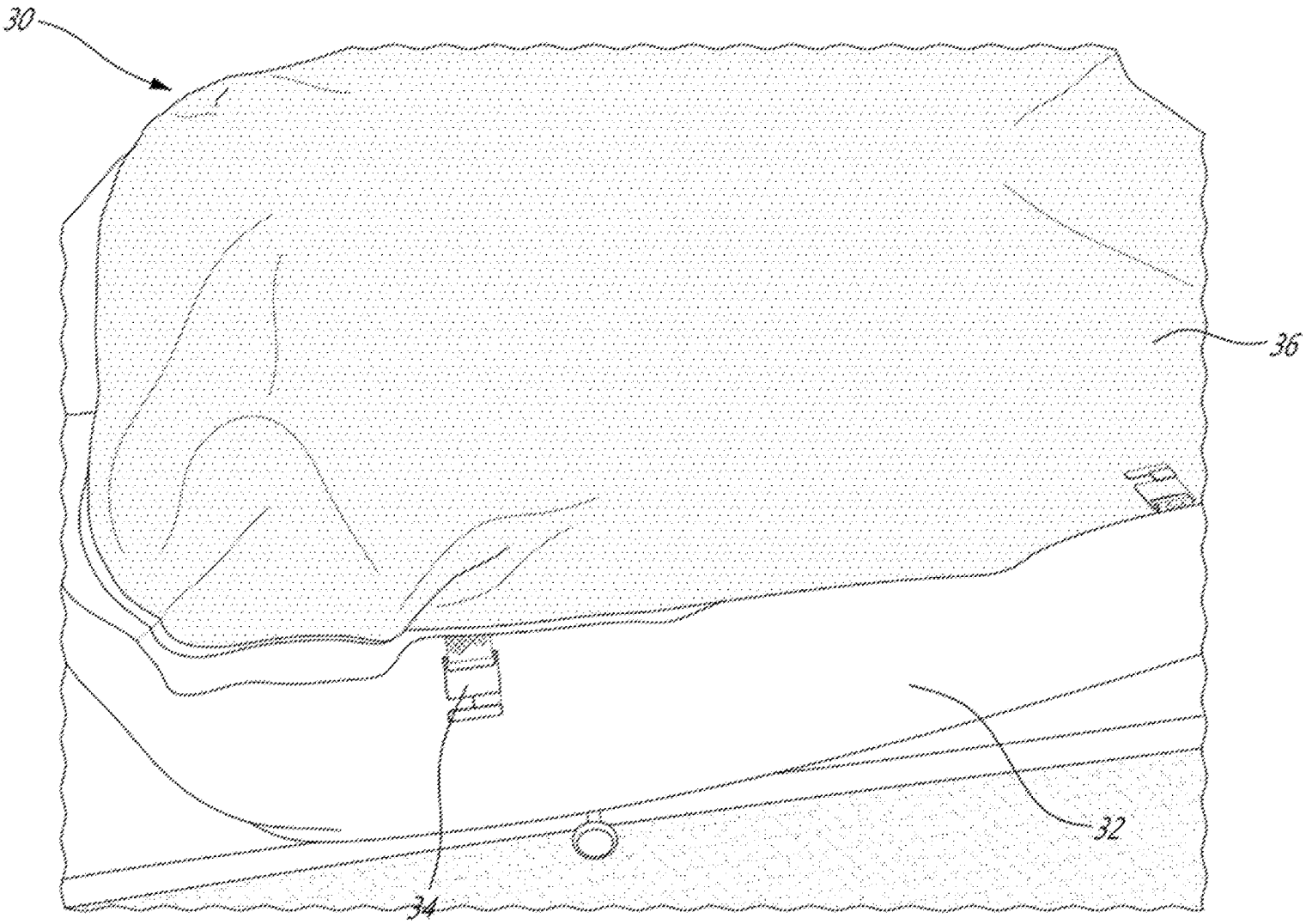
FIG. 7 is a top view of an embodiment of a cover for a mattress having variable height and hardness in accordance with the principles of the present invention.

Referring back to FIGS. 2 and 7, the mattress cover 30 is generally adapted to wrap around the top layers 20 and to cover the side walls of the base layer 10. In some embodiments, the mattress cover 30 comprises a top portion 36 adapted to cover the top area of the mattress and side walls 32 adapted to cover at least the top layers 20 and a portion of the base layer 10.

The mattress cover 30 comprises one or more attachment member 34. The attachment member 34 is attached or sewed to the cover 30. In some embodiment, to ensure a tension on the top surface 36 of the cover, the attachment member 34 is attached at the junction or edge of the surface 36 and side walls 32 of the cover 30.

In an exemplary embodiment, the top surface 36 of the cover 30 is made of lightly expandable material, such as expandable fabrics. In order to allow the extendable attachment system 40 to firmly hold the mattress cover 30 to the base layer 10, the side walls 32 of the cover are made of material having a rigidity superior to the rigidity of the material of the top surface 36 of the cover.

Still referring to FIG. 2, the extendable attachment system 40 is adapted to solidly attach the mattress cover 30 to the base layer 10. The extendable attachment system 40 may adapt to different heights of the mattress. Thus, as an example, the same attachment system 40 may be used to attach a stack comprising a base layer 10 with four (4) top layers 20 and a stack comprising a base layer 10 with only one top layer 20.

The attachment system 40 is typically made of a first attachment member 34 attached to the cover 30 and a second attachment member 14 attached to the slipcover 12, the first 34 and second 14 attachment members being adapted to receive one another and to adapt the length of the attachment system 40.

Figure 8:
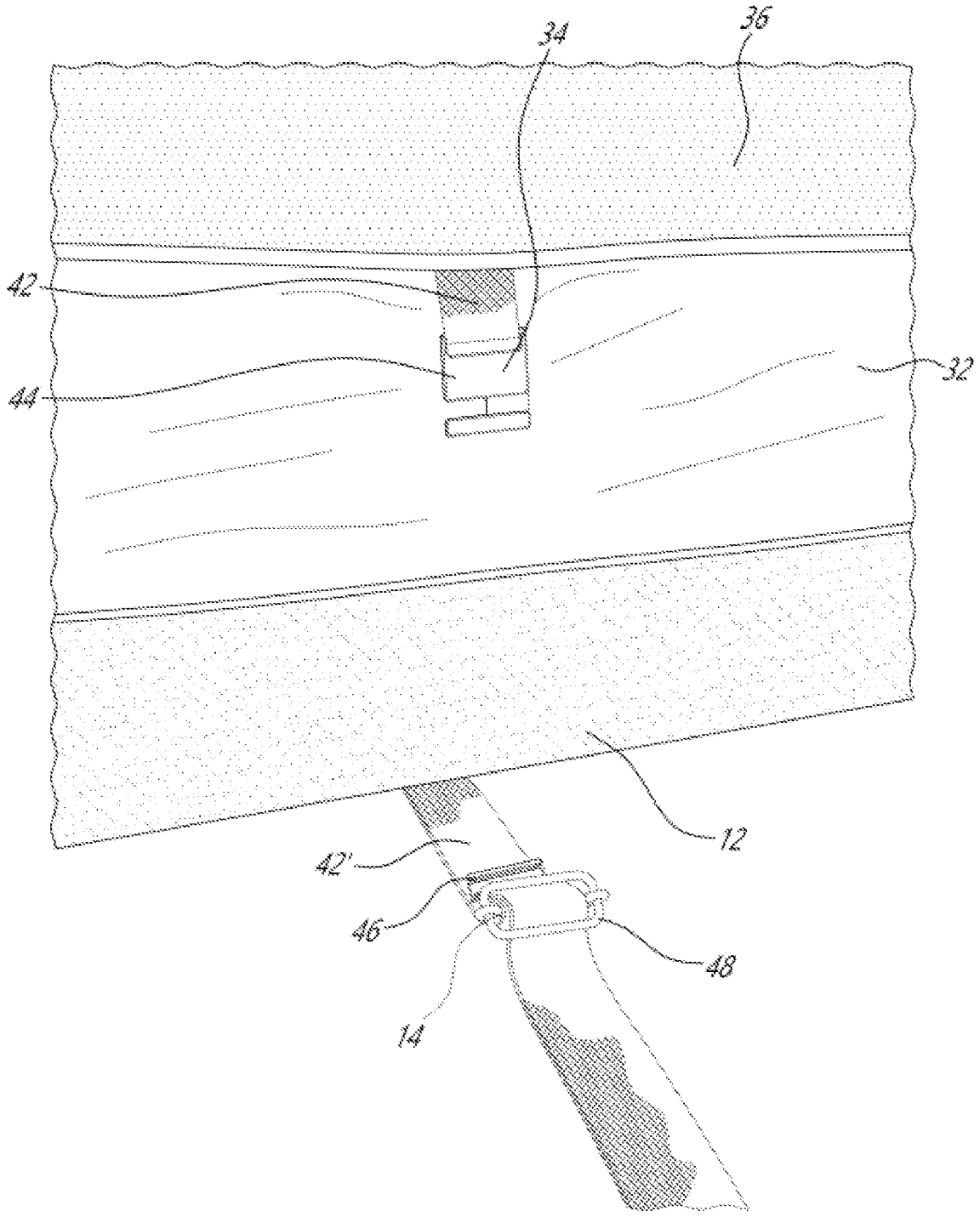
FIG. 8 is a perspective view of an embodiment of a mattress having variable height and hardness in an opened configuration.
Figure 9:
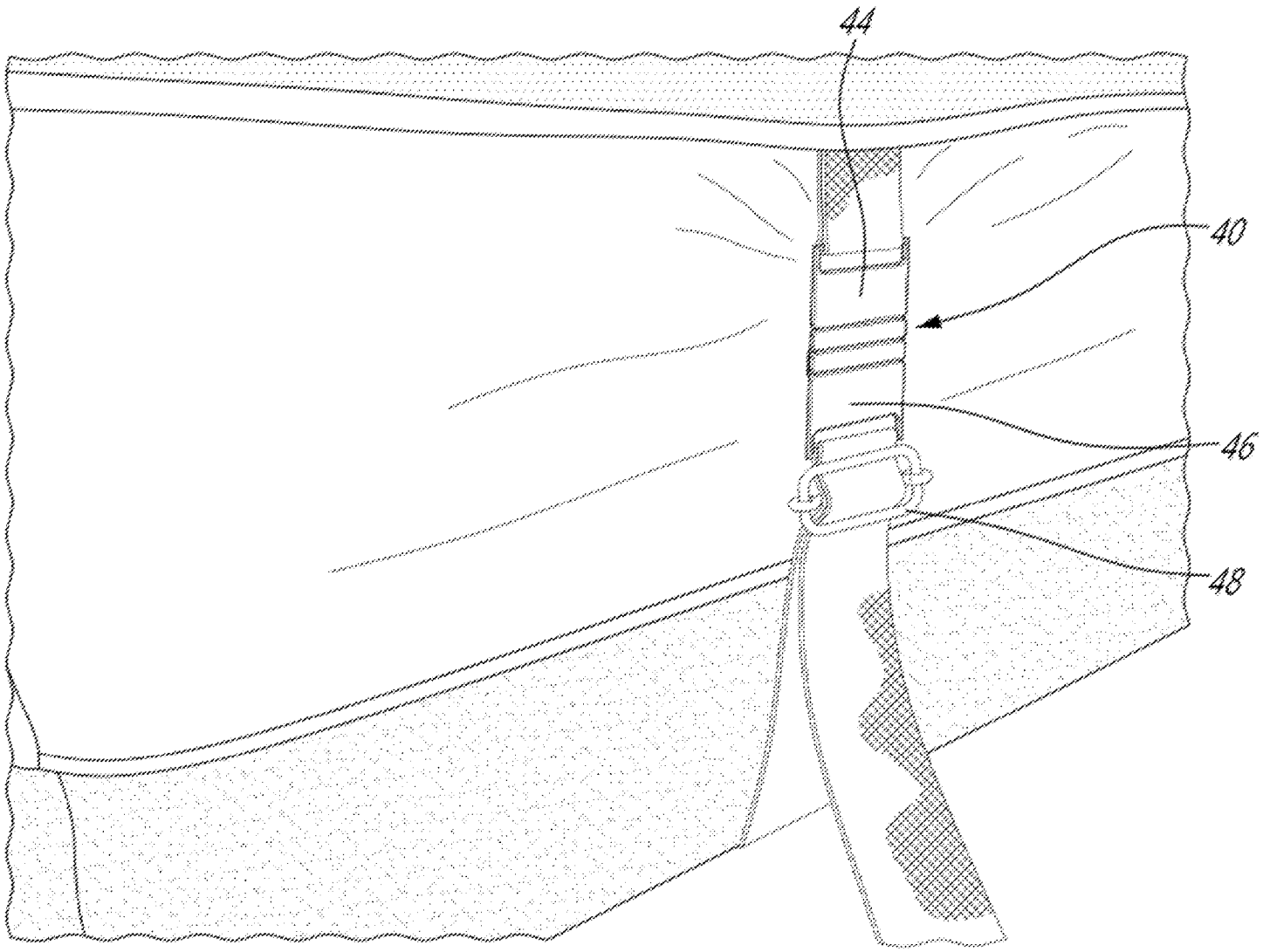
FIG. 9 is a perspective view of an embodiment of a mattress having variable height and hardness in an attached configuration.

Now referring to FIGS. 8 and 9, an exemplary embodiment of an expendable attachment system 40 is respectively shown in unattached or open configuration and in attached or working configuration. The exemplary attachment system 40 comprises a first buckle 44 and a second buckle 46 adapted to mate and attach with the first buckle 44. A first strap 42 is attached to the mattress cover 30 and a second strap 42' is attached to base layer cover 12 or to the base layer 10, typically at the bottom of the base cover 12 or of the base layer 10. The first buckle 44 is fixedly attached to one of the two straps 42, 42' and the second buckle 46 is fixedly attached to the second strap 42'. The attachment system 40 further comprises a length adjusting mechanism 48. In the present exemplary embodiment, the length adjusting mechanism 48 is embodied as an adjustable slide adapted to receive one of the two straps 42, 42'.

Understandably, one skilled in the art shall understand that any known attachment system 40 allowing to fixedly attach the mattress cover 30 to the base layer 10 and to allow changing the overall height of the mattress 1 by either inserting one or more layers 20 or by removing one or more present layer 20 may be used. As shown in FIGS. 8 and 9, to ensure ease of use, the attachment system 40 shall be resistant yet easy to use by a user.

As shown in FIG. 1, the mattress 1 typically comprises more than one attachment systems 40, such as two on each longitudinal side of the mattress. In order to allow the mattress 1 to bend or tilt or at least to allow the end portions of the mattress 1 to bend or tilt, such as in electrical beds or hospital beds, the attachment systems 40 are typically installed on a longitudinal side starting at about a quarter or a third of the length of the mattress 1.

Figure 10:
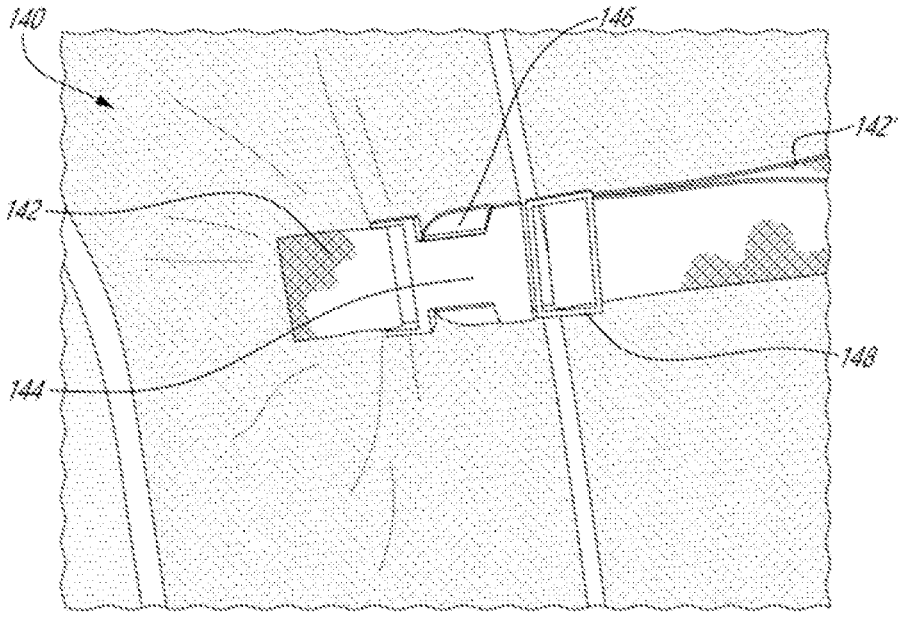
FIG. 10 is a side view of another embodiment of an attachment system in an attached configuration for a mattress having variable height and hardness in accordance with the principles of the present invention.
Figure 11:
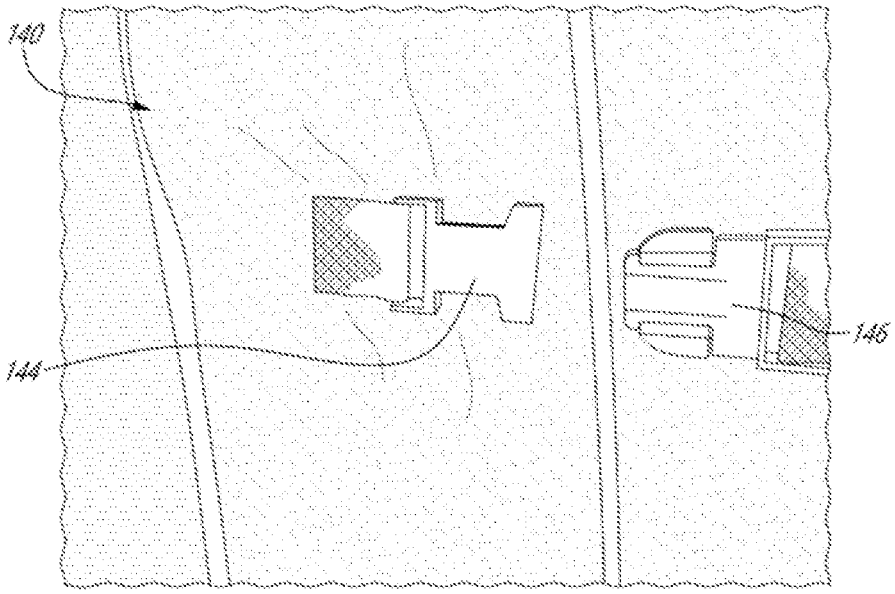
FIG. 11 is a side view of another embodiment of an attachment system in an open configuration for a mattress having variable height and hardness in accordance with the principles of the present invention.

Referring now to FIGS. 10 and 11, another embodiment of an attachment system 140 is respectively presented in unattached or open configuration and in attached or working configuration. The exemplary attachment system 140 comprises a female buckle or clip 144 and a male buckle or clip 146 adapted to mate and clip with the female buckle 144. Typically, a first strap 142 is attached to the mattress cover 30 and a second strap 142' is attached to the base layer cover 12 or to the base layer 10, typically at the bottom of the base cover 12 or of the base layer 10. The female buckle 144 is fixedly attached to one of the two straps 142, 142' and the male buckle 146 is fixedly, yet extendable, attached to the second strap 142'. The attachment system 140 further comprises a length adjusting mechanism 148 to expand or retract the second strap 142'. In the present exemplary embodiment, the length adjusting mechanism 148 is embodied as a typical adjustable slide adapted to receive one of the two straps 42, 42'.

A method for adjusting height and firmness of a mattress 1 is also provided. The method comprises providing a base mattress layer 10 adapted to support the weight of a user and stacking resilient layers 20 on top of the base layer 10 to adjust height and firmness of the mattress. The method further comprises wrapping a mattress cover 30 over a top surface of the topmost resilient layer 20, over the sides of the resilient layers 20 and over at least a portion of side walls of the base mattress layer 10. The method also comprises attaching the base layer 10 to the wrapped cover 30 of the mattress 10 and to tighten the base layer 10 to the wrapped cover 30. The tightening of the cover 30 results in the side 32 of the cover 30 to wrap around the side of the base layer 10.

To modify the configuration of the mattress 10 (i.e. firmness and/or height), a user may then detach the attachment systems 40 and remove the cover 30 from the top layers 20. The top layers 20 may be removed, shuffled or replaced with one or more resilient layers in order to change the firmness and/or height of the mattress 1. When many top layers 20 are stacked over the base layer 10, the attachment system 40 must be expanded or slacked to compensate for the increased height of the mattress 1. Alternatively, if top layers 20 are removed from the mattress 1, the attachment system 40 must be tightened to compensate from the reduced height of the mattress 1.

Understandably, the base layer 10 is typically made of long-lasting components known in the art, such as using a metal frame with springs, resistant resilient material or any other material used to build mattresses. The upper layers 20 generally tend to wear more quickly than the base layer 10, thus the said upper layers 20 may be replaced while keeping the original base layer 10. Keeping the base layer 10 generally tends to reduce costs of operation of the mattress, reduce wastes and material needed for the mattress over its lifespan.

A user may then easily adapt the firmness and/or height of the mattress to any changes in his condition (i.e. weight loss or gain, injury, etc.).

While illustrative and presently preferred embodiment(s) of the invention have been described in detail hereinabove, it is to be understood that the inventive concepts may be otherwise variously embodied and employed and that the appended claims are intended to be construed to include such variations except insofar as limited by the prior art.

The invention claimed is:

1. A mattress with adjustable height and hardness, the mattress comprising:

a base layer comprising a top surface, a bottom surface and a plurality of side surfaces;

at least two upper layers removably stacked on top of one another and over the base layer, the at least two upper layers being selected from a plurality of upper layers having different thicknesses and levels of hardness, each of the at least two upper layers comprising a top surface, a bottom surface and a plurality of side surfaces, the at least two upper layers being made of resilient material, the height and the hardness of the mattress varying according to the number of the at least two selected upper layers and to the thickness and the hardness levels of the selected upper layers;

a unitary flexible cover comprising:

a main portion covering the top surface of the topmost upper layer;

side walls covering the variable area formed by the variable height of the side surfaces formed by any combination of the at least two selected upper layers and covering at least a portion of the side surfaces of the base layer, an edge of the side walls wrapping around the side surfaces of the base layer;

a plurality of attachment mechanisms having a length varying according to the variable height of the mattress, each attachment mechanism comprising:

a first member secured to the flexible cover;

a second member secured to the base layer;

wherein the first member and the second member are adapted to detachably mate to one another to solidly maintain the flexible cover to the base layer.

2. The mattress of claim 1, the mattress further comprising a base cover adapted to wrap around the top surface, the bottom surface and the plurality of side surfaces of the base layer, the second member of the attachment mechanism being secured to the base cover.

3. The mattress of claim 2, the base cover being made of semi-rigid material.

4. The mattress of claim 1, the second member of each of the plurality of attachment mechanisms being attached to the bottom surface of the base layer.

5. The mattress of claim 1, wherein the top and the bottom surfaces of the at least two upper layers are made of material increasing friction between the layers.

6. The mattress of claim 1, wherein the top surface of a first of the at least two upper layers is adapted to frictionally engage with a bottom surface of a second of the at least two upper layers.

7. The mattress of claim 1, each of the upper layers having a hardness level being lower or equal than the base layer.

8. The mattress of claim 1, the side walls being made of a first expandable material and the main portion being made of a second material, the rigidity of the first material being different than the rigidity of the second material.

9. The mattress of claim 1, the mattress comprising four attachment mechanisms, the first members of two of the attachment mechanisms being attached per longitudinal side of the flexible cover and the second members of the two other attachment mechanisms being attached per longitudinal side of the base layer.

10. The mattress of claim 1, each of the attachment mechanisms comprising a length adjusting mechanism to vary the length of the attachment mechanisms according to the variable height of the mattress.

11. The mattress of claim 10, the mattress further comprising a first strap attached to the flexible cover and a second strap attached to the base layer, the attachment mechanisms comprising:

a first buckle attached to the first strap;

a second buckle attached to the second strap, the second buckle being adapted to mate and attach with the first buckle;

the length adjusting mechanism being an adjustable slide adapted to receive one of the first or second strap.

12. The mattress of claim 1, the side walls of the flexible cover seamlessly covering junctions between the plurality of side surfaces of the at least two upper layers and the plurality of side surfaces of the base layer.

13. A method for building a height and/or firmness adjustable mattress, the method comprising:

providing a base layer adapted to receive a predetermined load;

selecting at least two resilient upper layers from a plurality of upper layers having different thicknesses and levels of hardness;

stacking the least two selected upper layers on top of one another and on top of the base layer based to vary the height and hardness of the mattress according to the number of the at least two selected upper layers and to the thickness and the hardness levels of the selected upper layers;

covering at top surface of the topmost upper layer with a portion of a unitary flexible cover;

at least partially covering with side walls of the unitary flexible cover:

a variable area formed by the variable height of side surfaces formed by any combination of the at least two selected upper layers;

at least a portion of side surfaces of the base layer, an edge of the side walls wrapping around the side surfaces of the base layer;

adjusting length of each of a plurality of attachment mechanisms according to the variable height of the stacked base and upper layers, each of the attachment mechanisms being mounted to the base layer and to the flexible cover;

detachably securing, for each attachment system, the first attachment member to the second attachment member; and tightening each of the attachment mechanisms to limit movement of the base and upper layers.

14. The method of claim 13, each of the attachment system comprising a first attachment member mounted to the base layer and a second attachment member compatible with the first attachment member, the second attachment member being mounted to the flexible cover, the method further comprising coupling each of the first attachment member of the attachment systems to one of the second attachment member of the same attachment systems.

15. A method for adjusting height and/or firmness of a mattress, the method comprising:

detaching one or more attachment systems holding a unitary flexible cover to a base layer of the mattress;

removing a portion of the unitary flexible cover wrapped over a top surface of the topmost of the two resilient upper layers of the mattress selected from a plurality of upper layers having different thicknesses and levels of hardness;

removing side walls of the unitary flexible cover which are covering:

a variable area formed by the variable height of side surfaces formed by any combination of the at least two selected upper layers;

at least a portion of side surfaces of the base layer, an edge of the side walls wrapping around the side surfaces of the base layer;

replacing one or more of the two resilient upper layers with one or more replacement upper layers having different thickness and/or level of hardness; and adapting length of the attachment systems to compensate for the difference of height after replacement of the one or more two resilient upper layers.

16. The method for adjusting height and/or firmness of a mattress of claim 15, the method comprising adding one or more upper layers to the mattress instead of replacing one or more upper layers with one or more replacement upper layers.

17. The method for adjusting height and/or firmness of a mattress of claim 16, adapting length of the attachment systems comprising expanding the length of the attachment systems to compensate from the increased height of the mattress.

18. The method for adjusting height and/or firmness of a mattress of claim 15, the method comprising removing one or more of the upper layers of the mattress instead of replacing one or more upper layers with one or more replacement upper layers.

19. The method for adjusting height and/or firmness of a mattress of claim 18, adapting length of the attachment systems comprising tightening the length to compensate from the reduced height of the mattress.

* * * * *